US006078227A

United States Patent [19]

Buer et al.

[11] Patent Number: 6,078,227

[45] Date of Patent: Jun. 20, 2000

[54] DUAL QUADRATURE BRANCHLINE IN-PHASE POWER COMBINER AND POWER SPLITTER

[75] Inventors: Kenneth Vern Buer, Gilbert; Dean Lawrence Cook, Mesa, both of Ariz.

[73] Assignee: Motorola, Inc., Schaumburg, Ill.

[21] Appl. No.: 09/139,079

[22] Filed: Aug. 24, 1998

[51] Int. Cl.[7] ..... H01P 5/16

[52] U.S. Cl. ..... 333/117; 333/128

[58] Field of Search ..... 333/109, 115, 333/116, 117, 123, 127, 128

[56] References Cited

U.S. PATENT DOCUMENTS 3,219,949 11/1965 Heeren ..... 333/109

4,956,621 9/1990 Heckaman et al. ..... 333/128 X 5,412,354 5/1995 Quan ..... 333/121

*Primary Examiner*—Paul Gensler

*Attorney, Agent, or Firm*—Jeff D. Limon; Bradley J. Botsch; Frank J. Bogacz

[57] ABSTRACT

A dual quadrature branchline in-phase power combiner and power splitter provides a low cost and symmetrical structure for combining power from two signal ports (20, 30, FIG. 1) to an output signal port (10). When used as a power splitter, the structure accepts power from a signal port and divides the power equally and in-phase between the output signal ports (20, 30). The structure can be fabricated using microstrip, stripline, or similar technology such as suspended stripline. The structure is well matched over a large bandwidth and provides high isolation between the splitter output signal ports (20, 30).

18 Claims, 2 Drawing Sheets

DUAL QUADRATURE BRANCHLINE IN-PHASE POWER COMBINER AND POWER SPLITTER

FIELD OF THE INVENTION

The invention relates generally to the field of passive high frequency circuits and, more particularly, to microwave circuits for power combining and power splitting.

BACKGROUND OF THE INVENTION

In a communications system, techniques must be implemented for combining and distributing high frequency signals among various components. For example, in a system which receives high frequency communications signals through more than one antenna, the received signals must be combined in order to form a single signal. In a transmitter which uses more than one antenna, signals from a single source must be split into more than one signal in order for the signals to be present at the transmit antennas. A transmitter can also combine signals from several low power devices to form a high power signal for transmission through a single antenna.

At high frequencies, especially at microwave and millimeter wave frequencies, hybrid circuits are used in order to perform power combining and power splitting functions. Traditional branchline hybrids have a disadvantage in that they are asymmetric. In other words, the signal paths through the hybrid combiner or splitter are of unequal length. Thus, any losses which occur while signals are traveling through the hybrid power combiner or power splitter will be unequal. Therefore, signals cannot be split into essentially equal components. The problem is further complicated in that unequal power splitting also results in unequal frequency response, which results in amplitude imbalance at the edges of the operating band. This can be especially problematic when uniform signal magnitude is required at the outputs of a power splitter. Additionally, when used as a combiner, the loss of an input signal does not result in a predictable power output from the combiner structure.

A further drawback of a traditional asymmetric branchline hybrid splitter is that this type of structure produces outputs which have a quadrature phase relationship to each other. In many applications this is undesirable since additional phase shifting components must be added to compensate for the quadrature phase relationship between the signal outputs.

Waveguide magic tee structures are one option for producing in-phase power splitting or combining. However, a waveguide solution is often undesirable due to the size of the constituent wave guide components. Additionally, waveguide structures are inherently three dimensional and more costly to produce than corresponding microstrip and stripline approaches. Other structures exist for producing in-phase power combination and splitting such as the rat race or ring hybrid. However, these structures are also asymmetric and prone to undesirable coupling between input and output lines.

Another structure which can provide in-phase power combining and splitting is a Wilkinson hybrid. However, a Wilkinson hybrid requires the use of a lumped element resistor which functions as a circuit element. Therefore, as the physical length of the resistor approaches a quarter wavelength at the operating frequency, the performance of the hybrid is degraded. As the design frequency increases, any losses introduced by the physical length of the resistor become larger and larger, making the device unusable at millimeter wave frequencies. In addition to these limitations, a Wilkinson hybrid provides power splitting and power combining over a limited bandwidth. Although this bandwidth can be improved by using multiple sections, this increases the size required to implement the power combining and power splitting functions.

Therefore, what is needed is a power combiner and splitter which can be used over a greater bandwidth and provide in-phase power combining and power splitting.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

DESCRIPTION OF THE PREFERRED EMBODIMENTS

A dual quadrature branchline in-phase power combiner and power splitter provides a low cost high bandwidth alternative to conventional in-phase power combiners and splitters. The unique device can be fabricated using conventional microstrip or stripline technology, or variations of these technologies, such as suspended stripline. The resulting structure possesses excellent bandwidth as well as high return loss at each input and good isolation between input ports.

Figure 1:
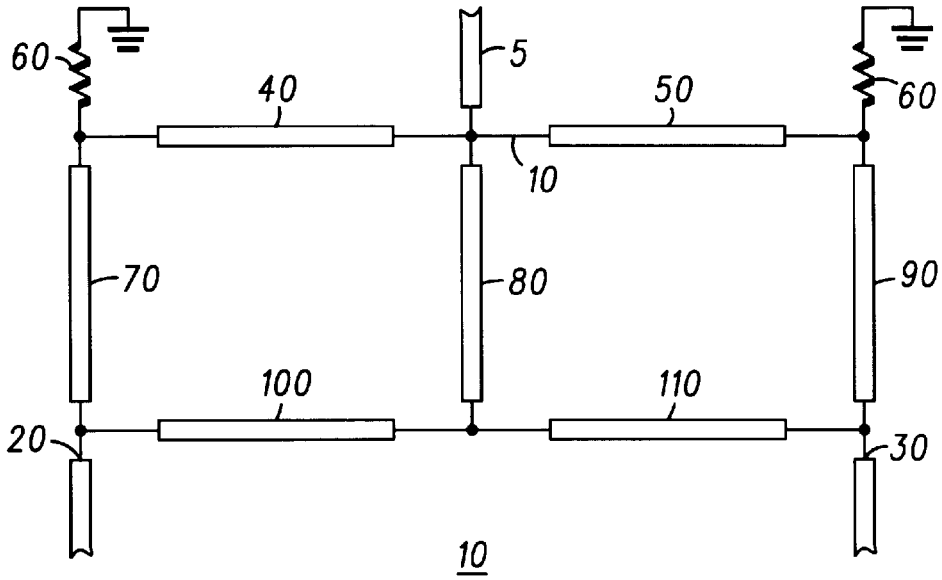
FIG. 1 illustrates a layout of a dual quadrature branchline in-phase power combiner and power splitter in accordance with a preferred embodiment of the invention.

FIG. 1 illustrates a layout of a dual quadrature branchline in-phase power combiner and power splitter in accordance with a preferred embodiment of the invention. In FIG. 1 signal port 10 accepts a high frequency signal input from an external source. Signal port 10 is coupled to transmission line 5 which possesses a characteristic impedance of a standard value, such as 50 or 75 Ohms. In an alternative embodiment, signal port 10 is coupled to a transmission line which possesses a nonstandard characteristic impedance, such as 100 Ohms. The use of standard impedances, such as 50 or 75 Ohms, allows a wide variety of compatible test equipment to be used with the combiner/splitter of FIG. 1 in order to assist in the testing of the combiner/splitter of FIG. 1 and in the integration of the structure into a larger system.

As the high frequency signal from transmission line 5 enters signal port 10, the high frequency signal is split into three signal components. A first signal component is conveyed through a first end portion of first upper transmission line element 40. A second signal component is conveyed through a first end portion of second upper transmission line element 50. A third signal component is conveyed through a first end portion of second (or middle) transverse transmission line element 80. First and second upper transmission line elements 40 and 50 are desirably of a characteristic impedance approximately equal to the characteristic impedance of transmission line 5 multiplied by the square root of 2. Therefore, when transmission line 5 possesses a characteristic impedance of 50 Ohms, first and second upper transmission line elements 40 and 50 are substantially equal to 70.7 Ohms. Additionally, second transverse transmission line element 80 possesses a characteristic impedance substantially equal to that of transmission line 5, or 50 Ohms.

Coupled at the second end portions of first upper transmission line element 40 and second upper transmission line element 50 are terminating impedances 60. In a preferred embodiment, these terminating impedances are substantially equal to the value of the characteristic impedance of transmission line 5, or 50 Ohms. Terminating impedances 60 can be realized through the use of lumped element resistive elements, lossy transmission lines, or other techniques used to bring about a terminating impedance of a specific value.

It should be pointed out that the physical or electrical length of terminating impedance 60 is not critical since terminating impedances 60 are not circuit elements. Thus, one advantage of the present invention lies in the independence of the length of terminating impedances 60 on the functionality of the dual quadrature branchline in-phase power combiner and splitter of FIG. 1.

Coupled in series to a first end portion of terminating impedances 60 and an outer end portion of first upper transmission line element 40 is first transverse transmission line element 70. As previously mentioned, second transverse transmission line element 80 is coupled to the inner end portions of first and second upper transmission line elements 40 and 50, as well as transmission line 5. Third transverse transmission line element 90 is serially coupled to an outer end portion of second upper transmission line element 50 and to an end portion of terminating impedances 60. In a preferred embodiment, first, second, and third transverse transmission line elements 70, 80, and 90, each possess characteristic impedances substantially equal to that of transmission line 5, or 50 Ohms.

Dispensed between the lower end portions of first and second transverse transmission line elements 70 and 80 is first lower transmission line element 100. Dispensed between the lower end portions of second and third transverse transmission line elements 80 and 90 is second lower transmission line element 110. In a preferred embodiment, first and second lower transmission line elements 100 and 110 possess characteristic impedances which are substantially equal to the characteristic impedance of transmission line 5 multiplied by the square root of 2, or 70.7 Ohms.

Signal port 20 which lies at the junction of first transverse transmission line element 70 and first lower transmission line element 100 provides a first signal power output when the structure of FIG. 1 is used as a power splitter. In a preferred embodiment, the amount of signal power present at signal port 20 is three dB less than the power present at signal port 10 at the design frequency. Signal port 30, which lies at the intersection of second transverse transmission line element 90 and second lower transmission line element 110 provides a second signal power output. In a preferred embodiment, the amount of signal power present at signal port 30 is three dB less than the power present at signal port 10 at the design frequency.

In an alternate embodiment, where an unequal power split is desired, the values of first and second upper and lower transmission line elements can be adjusted to bring about the unequal power split. For the case of an unequal power distribution from signal port 10 to signal ports 20 and 30, first upper transmission line element 40 and first lower transmission line element 100 each assume a characteristic impedance of $Z=Z_o\cdot(N)^{-1/2}$ where N equals the power split factor between signal ports 20 and 30. Additionally, second upper transmission line element 50 and second lower transmission line element 110 each assume a characteristic impedance of $Z=Z_o\cdot(1-N)^{31/2}$. By way of example, and not by way of limitation, assume that ⅓ of the power present at signal port 10 is desired at signal port 20, while ⅔ of the power is desired at signal port 30. For this example the power split factor, N, is equal to ⅓. Thus, when the value of transmission line 5 is 50 Ohms ($Z_o$=50), the values of first upper transmission line element 40 and first lower transmission line element 100 assume characteristic impedance values of $50\cdot(1/3)^{-1/2}$=86.603 Ohms. Further, the value of second upper transmission line element 50 and second lower transmission line element 110 assume characteristic impedance values of $50\cdot(2/3^{-1/2}$=61.237 Ohms.

It should be pointed out that the above synthesis of an unequal power split factor for the dual quadrature in-phase power combiner and power splitter of FIG. 1 can also be applied when the device is used as a power combiner. In this case, inputs from signal ports 20 and 30 can combine unequally to form a single signal at signal port 10. For the case of an unequal power combination factor, the design equations for the constituent transmission line elements are substantially identical. Thus, for the example given in the preceding paragraph, ⅓ of the signal power present at signal port 20 would be present at signal port 10, while ⅔ of the power present at signal port 30 would be present at signal port 10.

Each of the transmission line elements which comprise the dual quadrature in-phase power combiner and power splitter of FIG. 1 is desirably constructed using microstrip transmission lines of a length approximately equal to 1 quarter of the wavelength of the design frequency. In an alternate embodiment, each transmission line element can be constructed using stripline transmission lines. Those skilled in the art are aware of other transmission line structures which can be utilized to construct to be apparatus of the FIG. 1. It is intended that this patent encompass these alternatives structures as well.

Although the FIG. 1 has been described primarily as a power splitter, the structure of the FIG. 1 is suitable for use as a power combiner. When used as a power combiner, signals to be combined are input through signal ports 20 and 30. These signals are then combined in-phase, presented at signal port 10, and conveyed to the external environment through transmission line 5.

Figure 2:
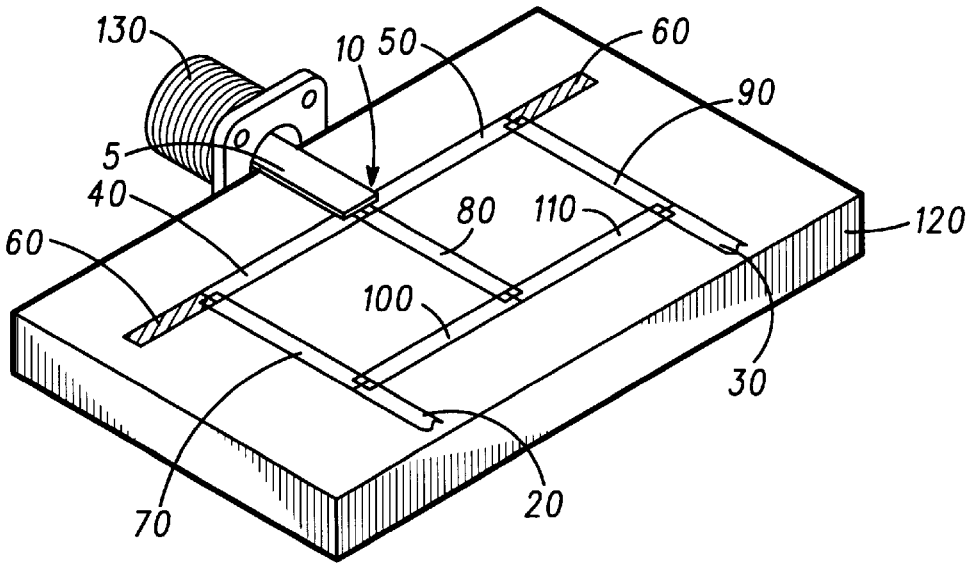
FIG. 2 shows the structure of FIG. 1 constructed using microstrip circuit technology and coupled to the external environment through a coaxial cable in accordance with a preferred embodiment of the present invention.

FIG. 2 shows the structure of FIG. 1 constructed using microstrip circuit technology and coupled to the external environment through a coaxial cable in accordance with a preferred embodiment of the present invention. In the circuit of FIG. 2, substrate 120 can be made of any suitable dielectric material, provided the dielectric constant is known and the loss properties of the dielectric ensure maximum power transfer as a high frequency signal is passed through the structure. The dimensions of first and second upper transmission line elements 40 and 50, first, second, and third transverse transmission line elements 70, 80, and 90, as well as first and second lower transmission line elements 100 and 110 can be determined through the use of well-known design equations.

FIG. 2 also illustrates coaxial cable connection 130 coupled to signal port 10. Coaxial cable connection 130 facilitates the connection of the dual quadrature branchline in-phase power combiner and power splitter to an external device such as an antenna, high power amplifier, or other appropriate device. Although shown connected to a single coaxial cable connection (130), the structure of FIG. 2 can be employed using coaxial cable connections to any and all of signal ports 10, 20, and 30. Additionally, these signal ports can be coupled to an external environment. using techniques other than the use of coaxial cable connection 130, such as a such as a waveguide probe, coplanar waveguide, or other well-known techniques.

Figure 3:
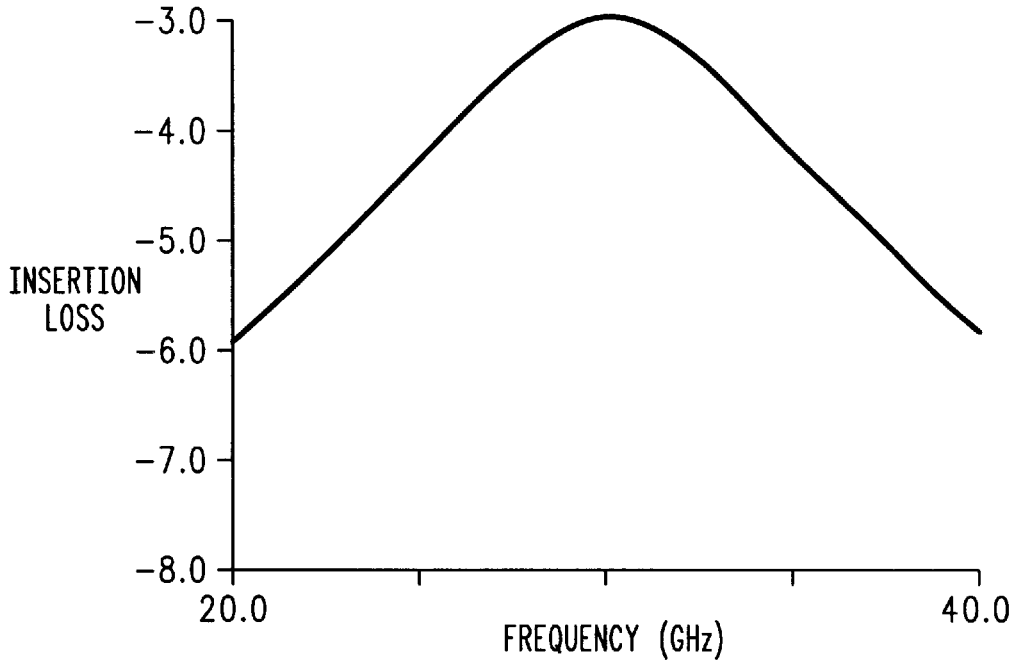
FIG. 3 provides the results of a computer simulation of the insertion loss from an input signal port to the output signal ports of the dual quadrature branchline in-phase coupler in accordance with a preferred embodiment of the invention.

FIG. 3 provides the results of a computer simulation of the insertion loss from an input signal port (10) to an output signal ports (20 and 30) of the dual quadrature branchline in-phase coupler in accordance with a preferred embodiment of the invention. When used as a splitter, the insertion loss from signal ports 10 to signal ports 20 and 30 are shown as a single line which indicates equal power distribution from signal port 10 to signal ports 20 and 30. As can be seen from FIG. 3, a design frequency of 30 GHz, produces an insertion loss from signal port 10 to signal ports 20 and 30 of 3 dB at the 30 GHz design frequency. At 20 and 40 GHz, this insertion loss is 6 dB. Thus, the dual quadrature branchline in-phase power combiner and splitter produces excellent insertion loss characteristics over a very wide bandwidth.

It should be noted that due to the reciprocity of the dual quadrature branchline in-phase coupler, the insertion loss from signal port 10 to signal port 20 is equal to that of the insertion loss from signal port 20 to signal port 10. Similarly, the insertion loss from signal port 10 to signal port 30 is equal to that of the insertion loss from signal port 30 to signal port 10.

Figure 4:
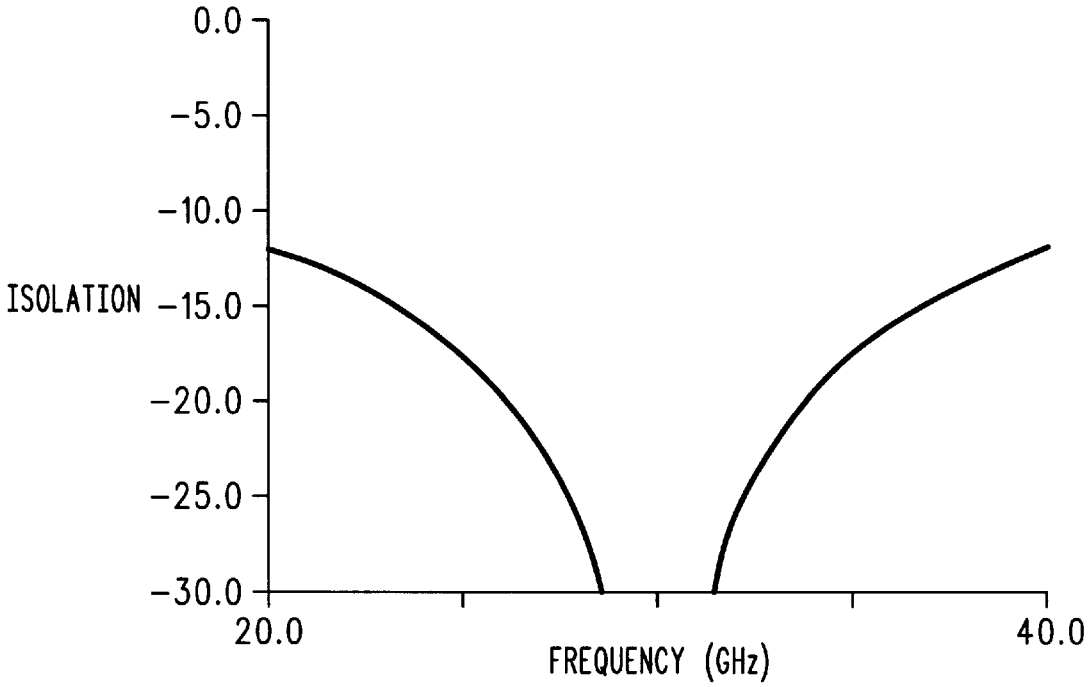
FIG. 4 provides the results of a computer simulation of the isolation between the output signal ports of a dual quadrature branchline in-phase coupler in accordance with a preferred embodiment of the invention.

FIG. 4 provides the results of a computer simulation of the isolation between the output signal ports of a dual quadrature branchline in-phase coupler in accordance with a preferred embodiment of the invention. When used as a combiner, the isolation between signal ports 20 and 30 is greater than 30 dB from approximately 28 to 32 GHz. Additionally, at 20 and 40 GHz, the isolation between ports 20 and 30 can be seen to be approximately 12 dB. The significance of this isolation is that in the event that one of signal ports 20 or 30 is shorted, or experiences another type of failure, the impedance of ports 20 and 30 will be only marginally affected.

A further advantage of the dual quadrature branchline in-phase coupler is that under this type of failure mode, half of the power coupled to the combiner through the remaining port will be delivered to signal port 10, while the other half will be dissipated through terminating impedances 60. Thus, one quarter of the power present at the remaining input is delivered to each of terminating impedances 60. This particular feature is in contrast with traditional hybrid combiners in which a single terminating impedance is used. The use of a single terminating impedance requires that one half of the power delivered to the resistor under failure conditions. Thus, in the dual quadrature branchline in-phase combiner of the present invention each resistor need possess half the power rating as a corresponding resistor used in a conventional hybrid coupler.

A dual quadrature branchline in-phase power combiner and power splitter provides a low cost high bandwidth alternative to conventional in-phase power combiners and splitters. The unique device can be used in a variety of applications such as satellite communications devices, satellite navigation devices, and high power amplifiers. The device can be fabricated using conventional microstrip or stripline technology. The resulting structure possesses excellent bandwidth as well as high return loss at each input and good isolation between input ports.

It is to be understood that the phraseology or terminology employed herein is for the purpose of description and not limitation. Accordingly, the invention is intended to embrace all such alternatives, modifications, equivalents and variations as fall within the true spirit and broad scope of the appended claims.

What is claimed is:

1. A dual quadrature branchline in-phase power combiner and power splitter which operates in a system having a characteristic impedance, comprising:

a first upper transmission line element of an impedance approximately equal to 1.414 multiplied by said characteristic impedance;

a second upper transmission line element of an impedance approximately equal to 1.414 multiplied by said characteristic impedance;

a second transverse transmission line element of an impedance substantially equal to said characteristic impedance, wherein a first end portion of said first upper transmission line element, a first end portion of said second upper transmission line element, and a first end portion of said second transverse transmission line element are coupled to a first signal port, a first terminating impedance substantially equal to said characteristic impedance is coupled to a second end portion of said first upper transmission line element and a second terminating impedance is coupled to a second end portion of said second upper transmission line element;

a first transverse transmission line element of an impedance substantially equal to said characteristic impedance;

a first lower transmission line element of an impedance approximately equal to 1.414 multiplied by said characteristic impedance, wherein a second end portion of said first transverse transmission line element and a first end portion of said first lower transmission line element are coupled to a second signal port, a second end portion of said first lower transmission line element is coupled to a second end portion of said second transverse transmission line element, a first end portion of said first transverse transmission line element is coupled to said second end portion of said first upper transmission line element;

a second lower transmission line element of an impedance approximately equal to 1.414 multiplied by said characteristic impedance; and a third transverse transmission line element of an impedance substantially equal to said characteristic impedance, wherein a first end portion of said second lower transmission line element and a second end portion of said third transverse transmission line element are coupled to a third signal port, a second end portion of said second lower transmission line element is coupled to said second end portion of said second transverse transmission line element, a first end portion of said third transverse transmission line element is coupled to said second end portion of said second upper transmission line element.

2. The dual quadrature branchline in-phase power combiner and power splitter of claim 1, wherein said first and second upper and lower transmission line elements, and said first, second, and third transverse transmission line elements are constructed using microstrip transmission lines.

3. The dual quadrature branchline in-phase power combiner and power splitter of claim 1, wherein said first and second upper and lower transmission line elements, and said first, second, and third transverse transmission line elements are constructed using stripline transmission lines.

4. The dual quadrature branchline in-phase power combiner and power splitter of claim 1, wherein said characteristic impedance is equal to 50 Ohms.

5. The dual quadrature branchline in-phase power combiner and power splitter of claim 1, wherein said first and second upper and lower transmission line elements, and said first, second, and third transverse transmission line elements are substantially equal to one quarter of the wavelength of a design frequency.

6. A power splitter for use at high frequencies, said power splitter having an input port, a first output port, and a second output port, said power splitter operating in a system having a characteristic impedance, comprising:

a first set of at least two transmission line elements coupled in series and dispensed between said input port and said first output port wherein a junction of said first set of at least two transmitions line elements is terminated by said characteristic impedance, wherein a first element of said first set of at least two transmission line elements is of an impedance approximately equal to 1.414 multiplied by said characteristic impedance, and wherein a second element of said first set of at least two transmission line elements is of an impedance substantially equal to said characteristic impedance;

a second set of at least two transmission line elements coupled in series and dispensed between said input port and said second output port wherein a junction of said second set of at least two transmission line elements is terminated by said characteristic impedance, wherein a first element of said second set of at least two transmission line elements is of an impedance approximately equal to 1.414 multiplied by said characteristic impedance, and wherein a second element of said second set of at least two transmission line elements is of an impedance substantially equal to said characteristic impedance; and a third set of at least two transmission line elements coupled in series and dispensed between said first and second output ports, wherein a junction of said third set of at least two transmission line elements is coupled to a middle transmission line element, said middle transmission line element also being coupled to said input port, wherein each element of said third set of at least two transmission line elements is of an impedance approximately equal to 1.414 multiplied by said characteristic impedance, and wherein said middle transmission line element is of an impedance substantially equal to said characteristic impedance.

7. The power splitter of claim 6, wherein each of said transmission line elements is constructed of microstrip transmission lines.

8. The power splitter of claim 6, wherein said junction of said first set of at least two transmission line elements and said junction of said second set of at least two transmission line elements are terminated using a 50 Ohm resistive element.

9. The power splitter of claim 6, wherein each of said transmission line elements is constructed of stripline transmission lines.

10. The power splitter of claim 6, wherein each of said transmission line elements is substantially equal to one quarter of the wavelength of a design frequency.

11. The power splitter of claim 6, wherein said power splitter is installed in a satellite communications device.

12. The power splitter of claim 6, wherein said power splitter is installed in a high power amplifier.

13. A power combiner for use at high frequencies, said power combiner having a first input port, a second input port, and an output port, each of said ports being of a characteristic impedance, comprising:

a first set of at least two transmission line elements coupled in series and dispensed between said first input port and said output port, wherein a junction of said first set of at least two transmission line elements is terminated with said characteristic impedance, and wherein a first element of said first set of at least two transmission line elements is of an impedance approximately equal to 1.414 multiplied by said characteristic impedance, and wherein a second element of said first set of at least two transmission line elements is of an impedance substantially equal to said characteristic impedance;

a second set of at least two transmission line elements coupled in series and dispensed between said second input port and said output port, wherein a junction of said second set of at least two transmission line elements is terminated with said characteristic impedance, and wherein a first element of said second set of at least two transmission line elements is of an impedance approximately equal to 1.414 multiplied by said characteristic impedance, and wherein a second element of said first set of at least two transmission line elements is of an impedance substantially equal to said characteristic impedance; and a third set of at least two transmission line elements coupled in series and dispensed between said first and second input ports, wherein a junction of said third set of at least two transmission line elements is coupled to a middle transmission line element, said middle transmission line element also being coupled to said output port, wherein each element of said third set of at least two transmission line elements is of an impedance approximately equal to 1.414 multiplied by said characteristic impedance, and wherein said middle transmission line element is of an impedance substantially equal to said characteristic impedance.

14. The power combiner of claim 13, wherein each of said transmission line elements is constructed using microstrip transmission lines.

15. The power combiner of claim 13, wherein each of said transmission line elements is constructed of stripline transmission lines.

16. The power combiner of claim 13, wherein each of said transmission line elements is substantially equal to one quarter of the wavelength of a design frequency.

17. The power combiner of claim 13, wherein said power combiner is installed in a satellite communications device.

18. The power combiner of claim 13, wherein said power combiner is installed in a high power amplifier.

* * * * *